US006972726B2

(12) United States Patent
Sato et al.

(10) Patent No.: US 6,972,726 B2
(45) Date of Patent: Dec. 6, 2005

(54) ANTENNA DEVICE AND WIRELESS COMMUNICATION APPARATUS USING THE SAME

(75) Inventors: Masahide Sato, Tokyo (JP); Hideaki Shimoda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/765,957

(22) Filed: Jan. 29, 2004

(65) Prior Publication Data

US 2004/0183736 A1 Sep. 23, 2004

(30) Foreign Application Priority Data

Jan. 31, 2003 (JP) ..... 2003-023550

(51) Int. Cl.[7] ..... H01Q 21/00
(52) U.S. Cl. ..... 343/725; 343/773
(58) Field of Search ..... 343/725, 773, 343/774, 908, 700 MS

(56) References Cited

U.S. PATENT DOCUMENTS

| | | | | |
|---|---|---|---|---|
| 3,868,694 A | | 2/1975 | Meinke | 343/753 |
| 3,942,180 A | * | 3/1976 | Rannou et al. | 343/725 |
| 6,052,889 A | | 4/2000 | Yu et al. | 29/600 |

FOREIGN PATENT DOCUMENTS

| | | |
|---|---|---|
| EP | 1 189 305 A2 | 3/2002 |
| JP | 08-139515 | 5/1996 |
| JP | 9-83238 | 3/1997 |
| JP | 2001-185942 | 7/2001 |
| JP | 2001-313514 | 11/2001 |

OTHER PUBLICATIONS

European Search Report dated Apr. 26, 2004.
Kuroda, et al., "A Study of Small Broadband Antenna I-Property of Dielectric Covered Mono-conical Antenna", Proceedings of the 2003 IEICE General Conference, p. 131.
Yamaura, et al., "A Study of Small Broadband Antenna II-Downsizing of Dielectric Covered Mono-conical Antenna", Proceedings of the 2003 IEICE General Conference, p. 132.
Japanese Office Action, dated May 24, 2005, with partial English translation.

* cited by examiner

*Primary Examiner*—Hoang V. Nguyen
(74) *Attorney, Agent, or Firm*—McGinn IP Law Group, PLLC

(57) ABSTRACT

An antenna device forms a discone antenna and comprises a pole-shaped base member 10*a* composed of dielectric material. The pole-shaped base member 10*a* has a cone-shaped inner space formed therein. In an inside surface of the pole-shaped base member 10*a*, a first antenna element 11 is formed by patterning a metal conductor layer. Further, on a plain surface facing the outside of the pole-shaped base member 10*a*, a second antenna element 12 is formed also by circularly patterning a metal conductor layer at the side of a top of the first antenna element 11 with a predetermined space being kept between the top of the first antenna element 11 and the second antenna element 12. The first antenna element 11 and the second antenna element 12 are located with respective rotation central axes thereof being corresponding with each other.

20 Claims, 12 Drawing Sheets

ANTENNA DEVICE AND WIRELESS COMMUNICATION APPARATUS USING THE SAME

BACKGROUND OF THE INVENTION

The present invention relates to an antenna device, in particular to the antenna device preferably for use in a wide band communication system, an ultra wide band communication system, and the like.

A wide frequency band becomes capable of being used in frequencies higher than a micro wave band. It is therefore possible to realize a wide band wireless communication system suitable for a high speed transmission of large capacity data, such as image data, and the like. Subsequently, development is proceeding in recent years directed to realization of communication technique capable of further wide band and high speed communication. As one of such means for carrying out high speed transmission of information thus mentioned by wireless communication, a communication system using an UWB (Ultra Wide Band) wireless technique, that is, UWB wireless system has been recently remarkable.

The UWB wireless system uses a very wide frequency band larger than several GHz in width. As a result, it is required that a frequency characteristic of an antenna device used in the UWB wireless system ranges a so far wide band, for example, such a wide band that ranges frequencies two times through ten times higher than the lowest frequency.

As an antenna device having such a wide band characteristic, for example, a discone antenna, a biconical antenna, a Brown antenna, a conical whip antenna, or the like can be pointed out. These antenna devices are constituted by a combination of antenna elements each composed of a metal conductor having a bar-shaped, a pole-shaped, a cylinder-shaped, a cone-shaped, or a disc-shaped configuration (generally, by a combination of two antenna elements having the same configurations as each other or different configurations from each other).

In the interim, as a structure of the antenna element in an actual product level, the antenna element is sometimes composed of linear members, as will later be described more in detail. In such a case, in order to obtain a desirable antenna shape or constitution, it becomes necessary that the linear members are fixed and holded by the use of an additional member of a separator, or the like made of insulating materials, such as a fluoride resin, an ABS resin, and the like. As a result, the structure of the antenna element inevitably becomes complicated. Accordingly, many manufacturing steps are required for mounting the antenna elements.

As a technique for solving such problems in structure or mounting of the antenna elements, for example, Japanese laid open Official Gazette No.313514/2001 discloses an antenna element that a helical plating has been provided on inner surfaces of a cylindrical body thereof.

However, only one antenna element is shown in the technique disclosed in the Official Gazette. Therefore, the antenna element, as it stands, cannot constitute an antenna device that carries out transmission and reception of signals.

SUMMARY OF THE INVENTION

It is an object of the present invention to provide an antenna device capable of being readily mounted in spite of a plain structure of the antenna device.

It is another object of the present invention to provide a wireless communication apparatus using the antenna device of the type described.

According to an aspect of the present invention, there is provided an antenna device for use in a wireless communication apparatus, comprising: a base member which is composed of a dielectric material and which has a peripheral surface and a plain surface; a first antenna element which is formed on the peripheral surface of the base member with the first antenna element having a three-dimensional configuration; and a second antenna element which is formed on either the peripheral surface or the plain surface of the base member with a predetermined distance being kept from the first antenna element, the second antenna element having a three-dimensional configuration when formed on the peripheral surface, the second antenna element having a two-dimensional configuration when formed on the plain surface.

The three-dimensional configuration may be a circular cone-shaped configuration, a pyramid-shaped configuration, a pole-shaped configuration, or a tube-shaped configuration.

The two-dimensional configuration may be a plane-shaped configuration.

The first antenna element may be formed on an inner peripheral surface of the base member.

The second antenna element may be formed on an inner peripheral surface of the base member.

The first antenna element and the second antenna element may be formed with respective rotation central axes thereof being corresponding with each other.

The antenna device may further comprise a third antenna element which is formed on the base member with a predetermined distance being kept with respect to the first and the second antenna elements.

According to another aspect of the present invention, there is also provided a wireless communication apparatus in which the antenna device is used, wherein a signal from a signal source is supplied to the first antenna element while a ground voltage is supplied to the second antenna element.

In the wireless communication apparatus in which the antenna device is used, a signal from a signal source may be supplied to the second antenna element while a ground voltage may be supplied to the first antenna element.

In the wireless communication apparatus in which the antenna device is used, the third antenna element may be a parasitic antenna.

DETAILED DESCRIPTION OF THE PREFERRED EMBODIMENTS

Referring to FIGS. 1 through 5, description is, at first, made about conventional antenna devices in order to facilitate an understanding of the present invention.

Figure 1:
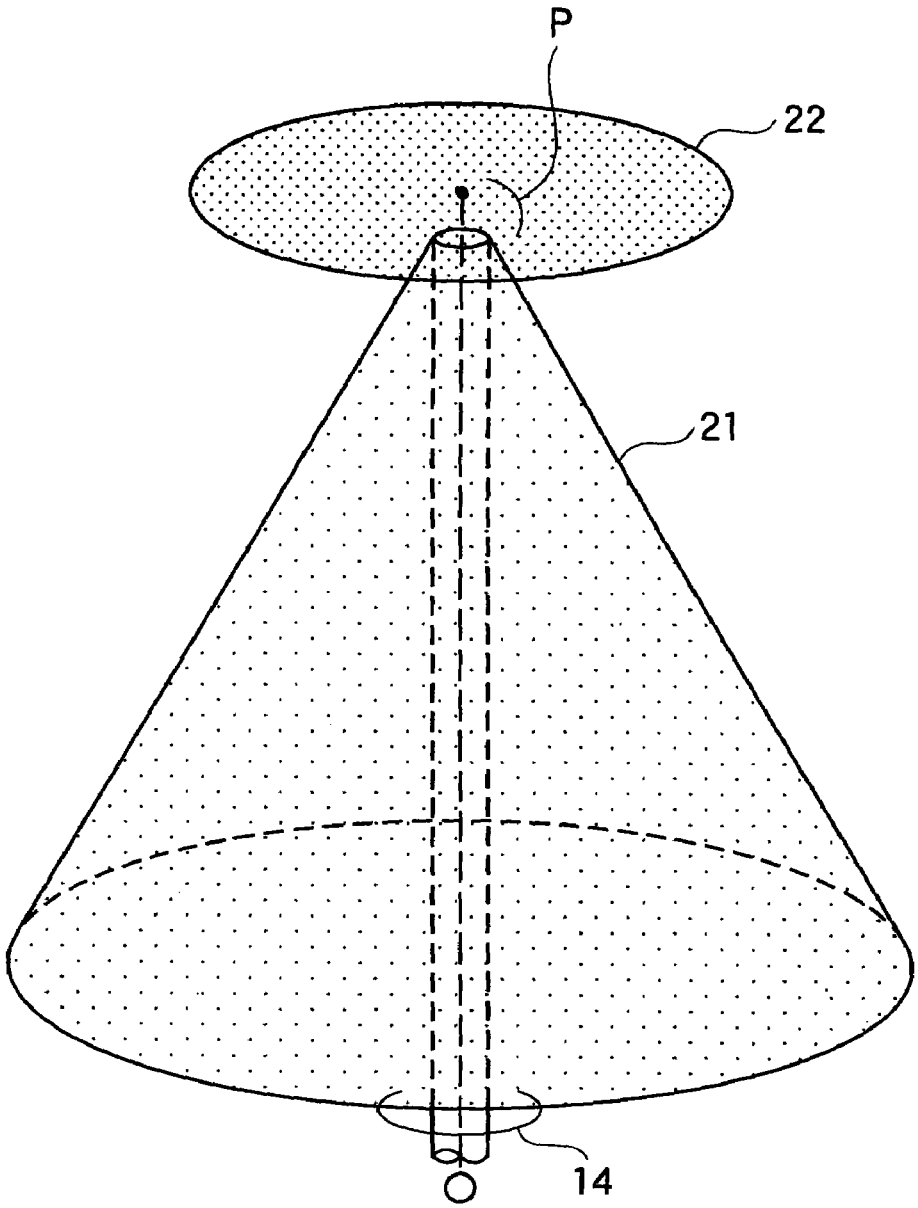
FIG. 1 PRIOR ART
FIG. 1 is an explanation view for schematically showing an example of a structure of a conventional discone antenna.

In FIG. 1, illustrated is an example of a structure of a conventional discone antenna. As illustrated in FIG. 1, the conventional discone antenna comprises a conical conductor element 21, and a disc-shaped conductor element 22 which is located closely to the conical conductor element 21 with a predetermined space being kept between a top of the conical conductor element 21 and the disc-shaped conductor element 22. The disc-shaped conductor element 22 is located coaxially with the conical conductor element 21. Namely, a rotation axis of the disc-shaped conductor element 22 is corresponding with that of the conical conductor element 21. With the structure, by a coaxial cable 14, a signal is supplied to the conventional discone antenna from a center of the disc-shaped conductor element 22 as a feeding point P while a ground voltage is supplied to the conventional discone antenna from a top of the conical conductor element 21 as a feeding point P.

Figure 2:
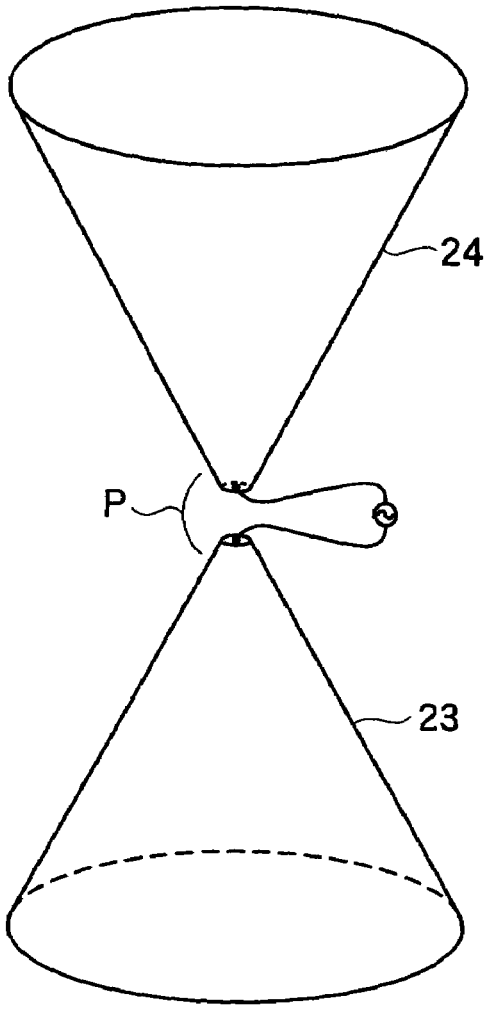
FIG. 2 PRIOR ART
FIG. 2 is an explanation view for schematically showing a structure of a conventional biconical antenna.

In FIG. 2, illustrated is a structure of a conventional biconical antenna. As illustrated in FIG. 2, the conventional biconical antenna comprises two conical conductor elements 23 and 24. The two conical conductor elements 23 and 24 are located closely to each other with respective rotation central axes thereof being corresponding with each other and with respective tops thereof facing oppositely to each other. With the structure, signals are supplied to the conventional biconical antenna from the respective tops of the two conical conductor elements 23 and 24 as respective feeding points P.

Figure 3:
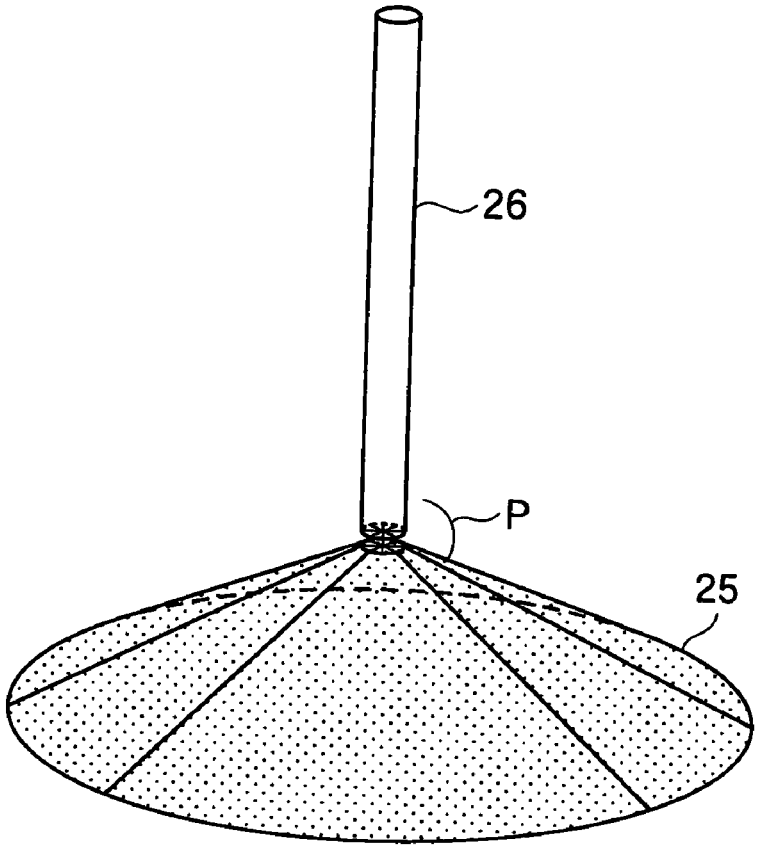
FIG. 3 PRIOR ART
FIG. 3 is an explanation view for schematically showing a structure of a conventional Brown antenna.

In FIG. 3, illustrated is a structure of a conventional Brown antenna. As illustrated in FIG. 3, the conventional Brown antenna comprises a conical conductor element 25, and a pole-shaped conductor element 26 which is located closely to the conical conductor element 25 with a predetermined space being kept between a top of the conical conductor element 25 and coaxially with the conical conductor element 25. Namely, a rotation axis of the pole-shaped conductor element 26 is corresponding with that of the conical conductor element 25. With the structure, a signal is supplied to the conventional Brown antenna from an end of the pole-shaped conductor element 26 as a feeding point P while a ground voltage is supplied to the conventional Brown antenna from a top of the conical conductor element 25 as a feeding point P.

Figure 4:
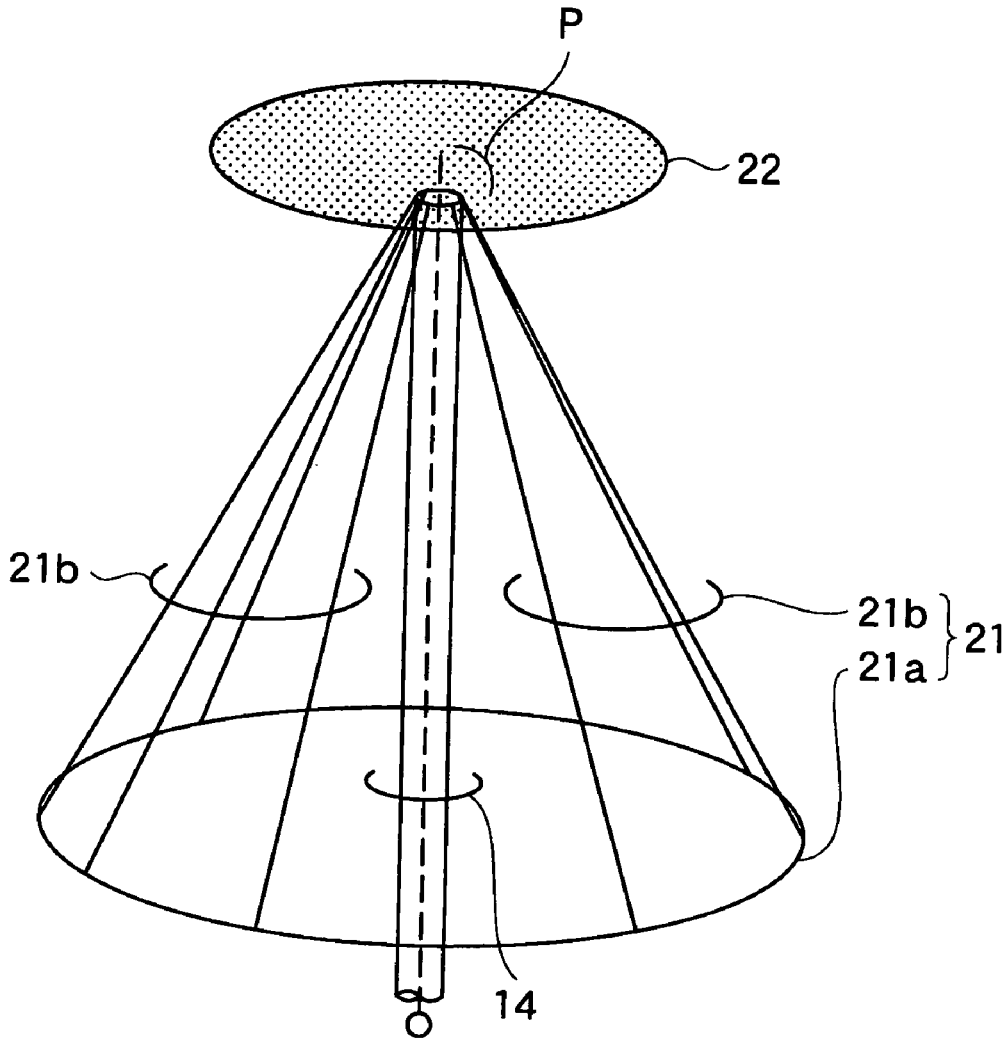
FIG. 4 PRIOR ART
FIG. 4 is an explanation view for schematically showing another example of a structure of a conventional discone antenna.
Figure 5:
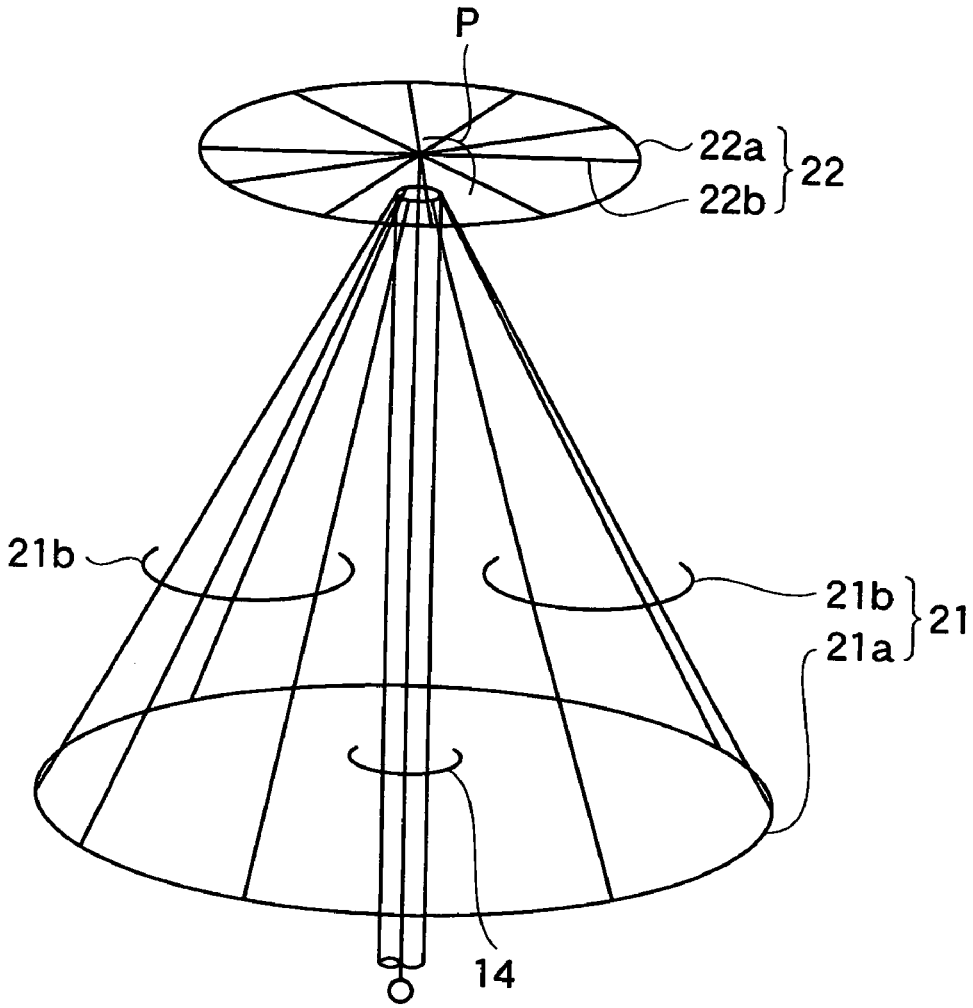
FIG. 5 PRIOR ART
FIG. 5 is an explanation view for schematically showing yet another example of a structure of a conventional discone antenna.

Herein, an example of a structure of the antenna element in an actual product level is illustrated in FIGS. 4 and 5. FIG. 4 shows an example of a structure of a conventional discone antenna while FIG. 5 shows another example of a structure of a conventional discone antenna. In FIG. 4, the conventional discone antenna has a conical conductor element 21 and a disc-shaped conductor element 22. The disc-shaped conductor element 22 is similar to that illustrated in FIG. 1. On the other hand, the conical conductor element 21 in FIG. 4 comprises a linear annulus conductor portion 21*a* and a plurality of linear and radial conductor portions 21*b* which are located at pitches equal to each other and by which a top of the linear and radial conductor portions 21*b* is connected to the linear annulus conductor portion 21*a*. Further, in addition to such the conical conductor element 21 depicted in FIG. 4, a disc-shaped conductor element 22 in FIG. 5 comprises a linear annulus conductor portion 22*a* and a plurality of linear and radial conductor portions 22*b* which are located at pitches equal to each other and by which a center point of the linear and radial conductor portions 22*b* is connected to the linear annulus conductor portion 22*a*.

However, problems are caused to occur, as mentioned in the preamble of the instant specification, in a case that the antenna element is composed of linear members thus mentioned. Namely, in order to obtain a desirable antenna shape or constitution, it becomes necessary that the linear members are fixed and holded by the use of an additional member of a separator, or the like made of insulating materials, such as a fluoride resin, an ABS resin, and the like. As a result, the structure of the antenna element inevitably becomes complicated. Accordingly, many manufacturing steps are required for mounting the antenna elements.

Now, referring to the drawings, embodiments of the present invention will be described more concretely. Herein, the same members are designated by the same reference numerals in the attached drawings. Further, overlapped description will be omitted. Besides, the embodiments of the invention are particularly useful embodiments for carrying out the present invention. The present invention is therefore not restricted to the embodiments.

Figure 6:
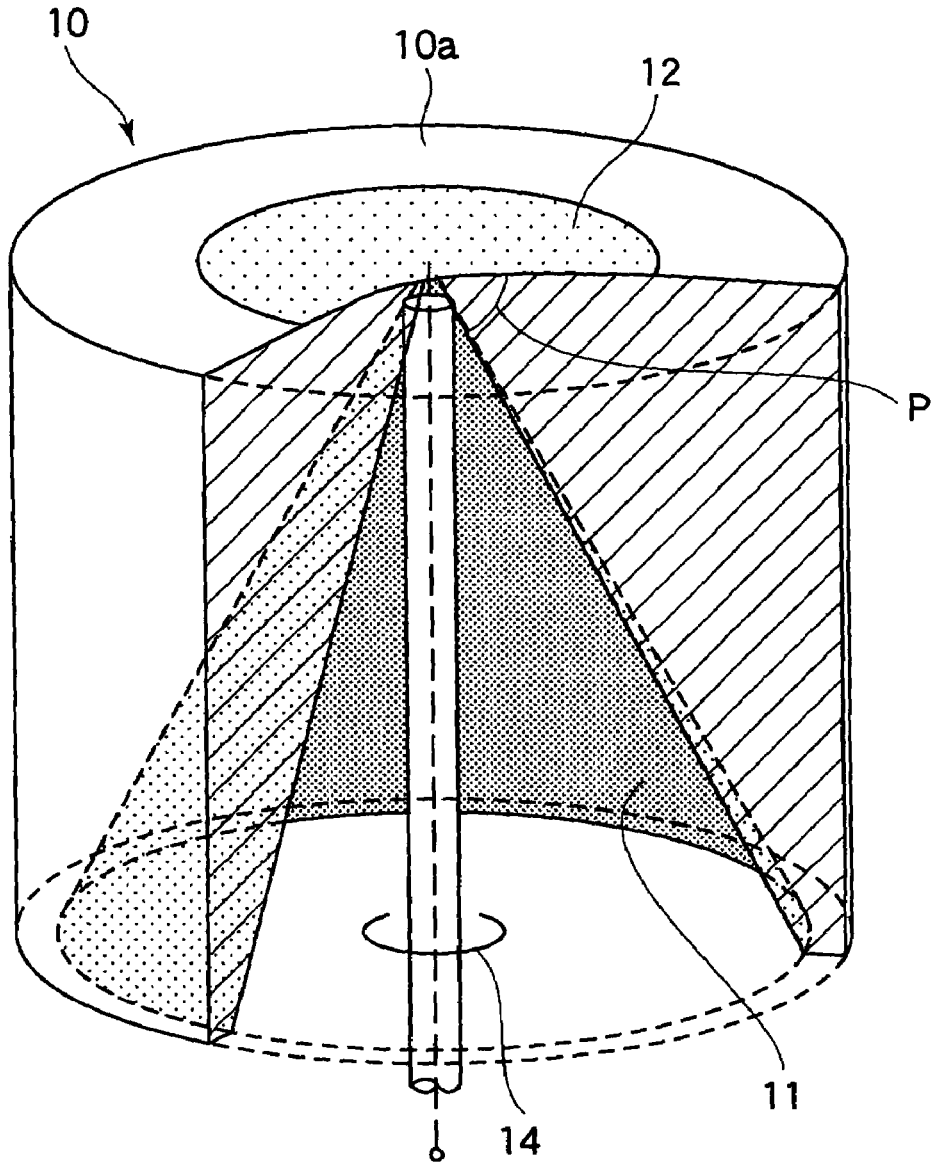
FIG. 6 is a perspective view for schematically showing an antenna device according to a first embodiment of the present invention with a part of the antenna device being torn.
Figure 7:
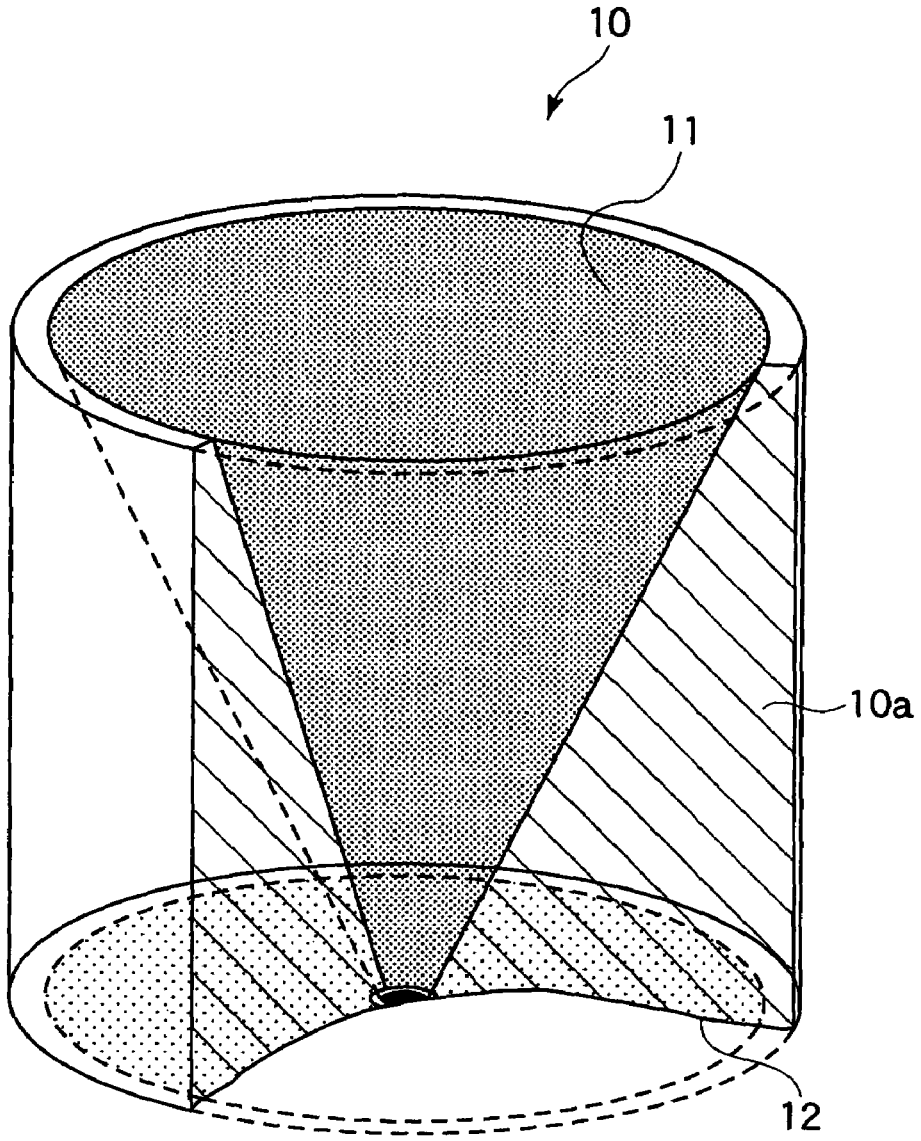
FIG. 7 is a perspective view for schematically showing an antenna device according to a second embodiment of the present invention with a part of the antenna device being torn.
Figure 8:
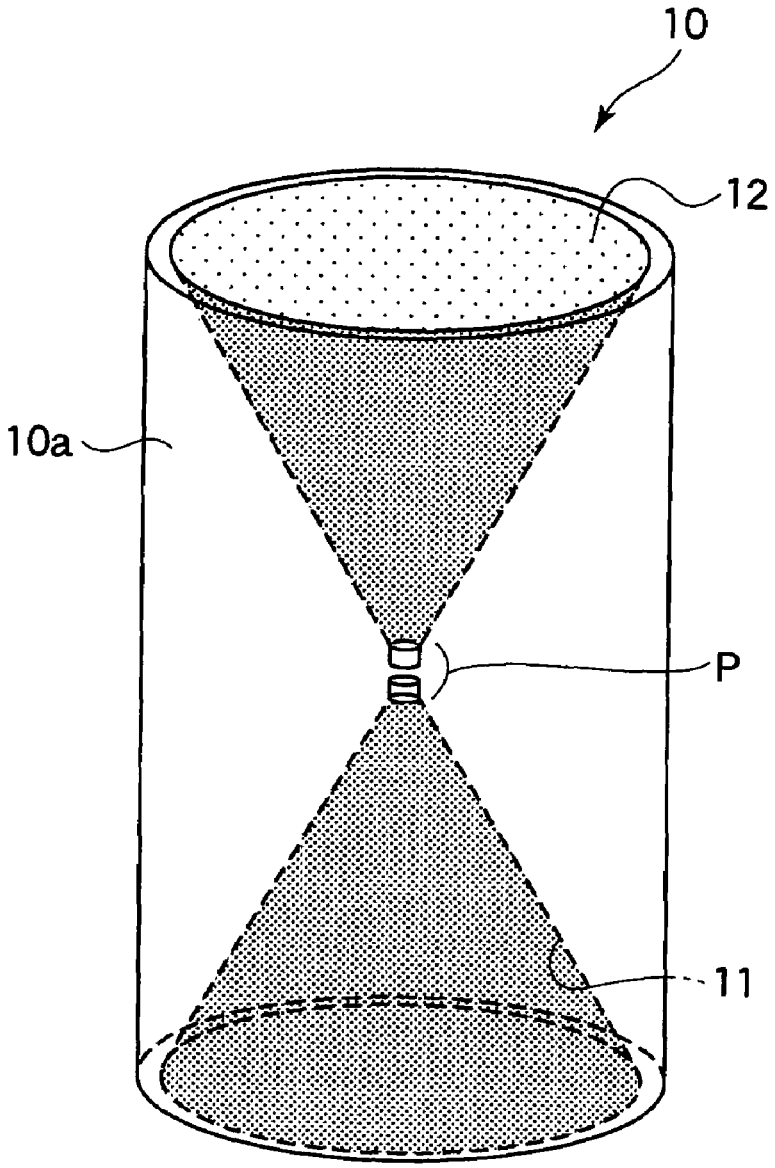
FIG. 8 is a perspective view for schematically showing an antenna device according to a third embodiment of the present invention with a part of the antenna device being torn.
Figure 9:
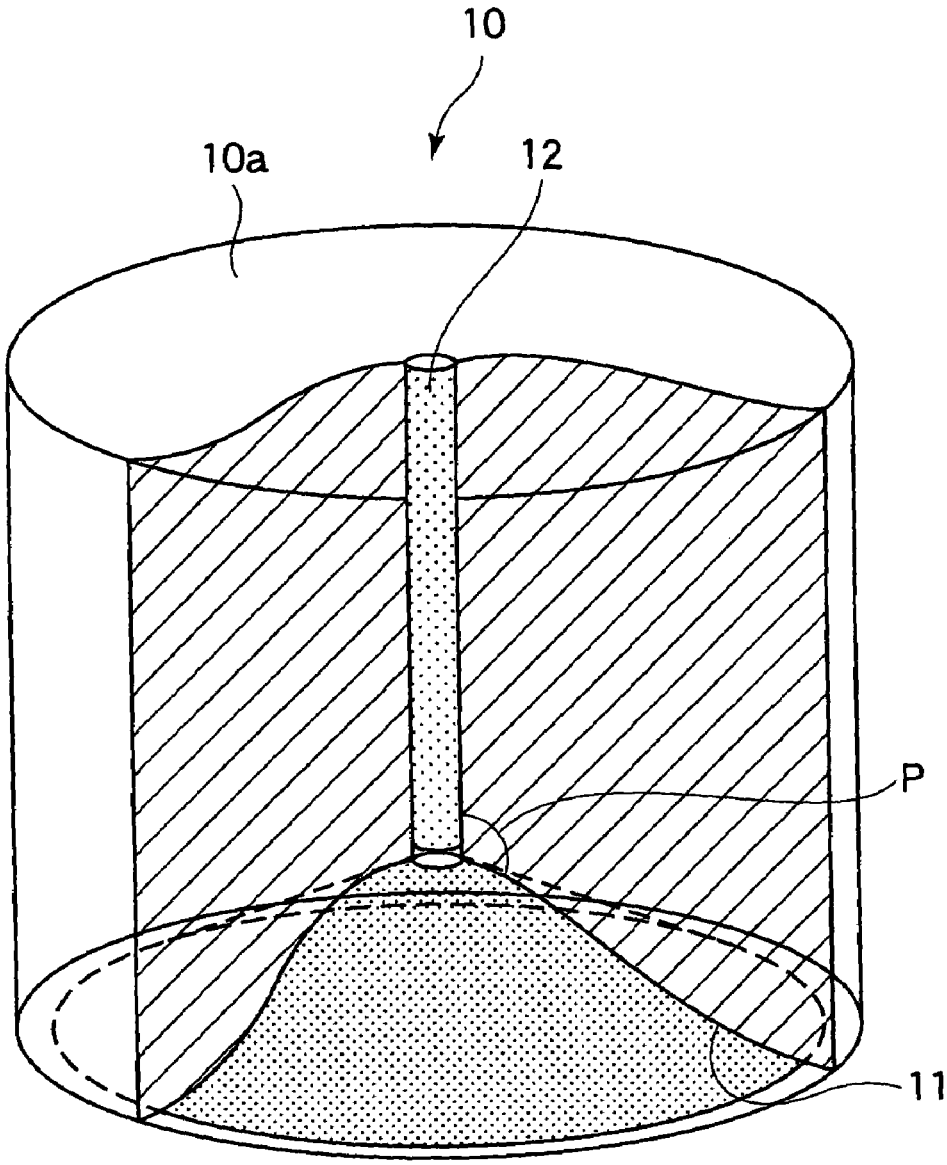
FIG. 9 is a perspective view for schematically showing an antenna device according to a fourth embodiment of the present invention with a part of the antenna device being torn.
Figure 10:
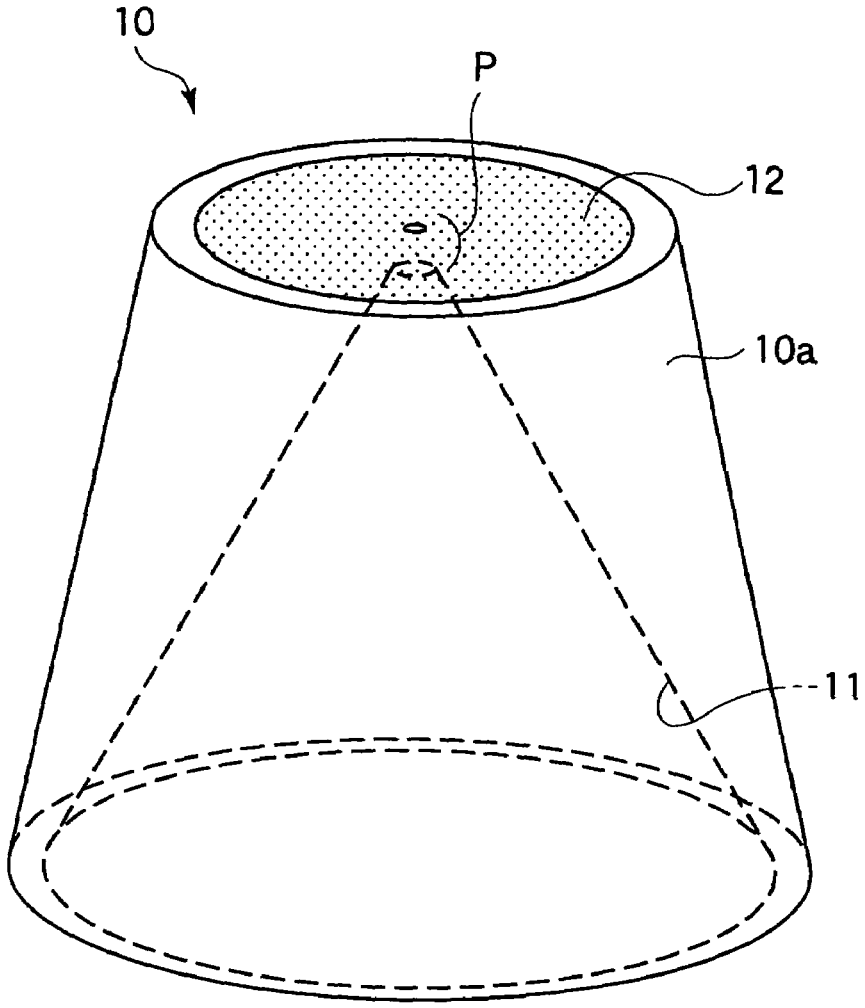
FIG. 10 is a perspective view for schematically showing an antenna device according to a fifth embodiment of the present invention.
Figure 11:
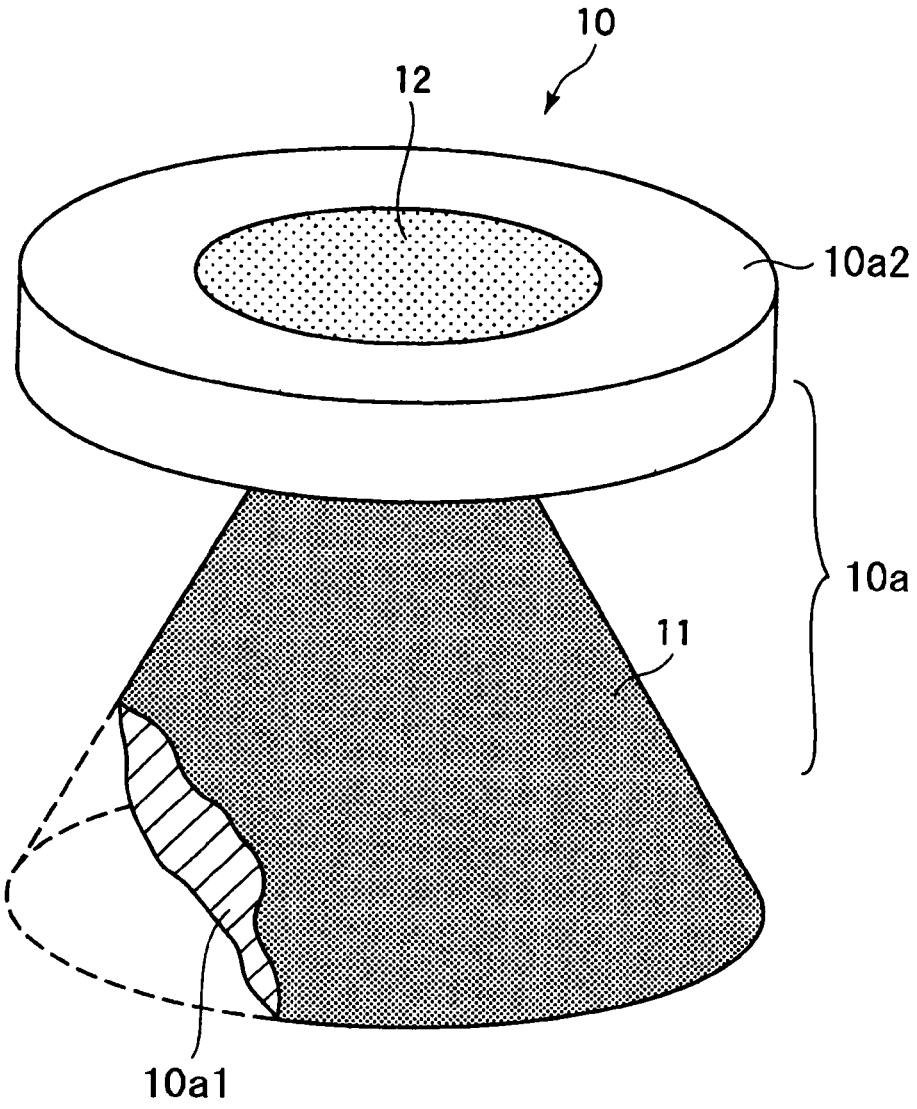
FIG. 11 is a perspective view for schematically showing an antenna device according to a sixth embodiment of the present invention with a part of the antenna device being torn.
Figure 12:
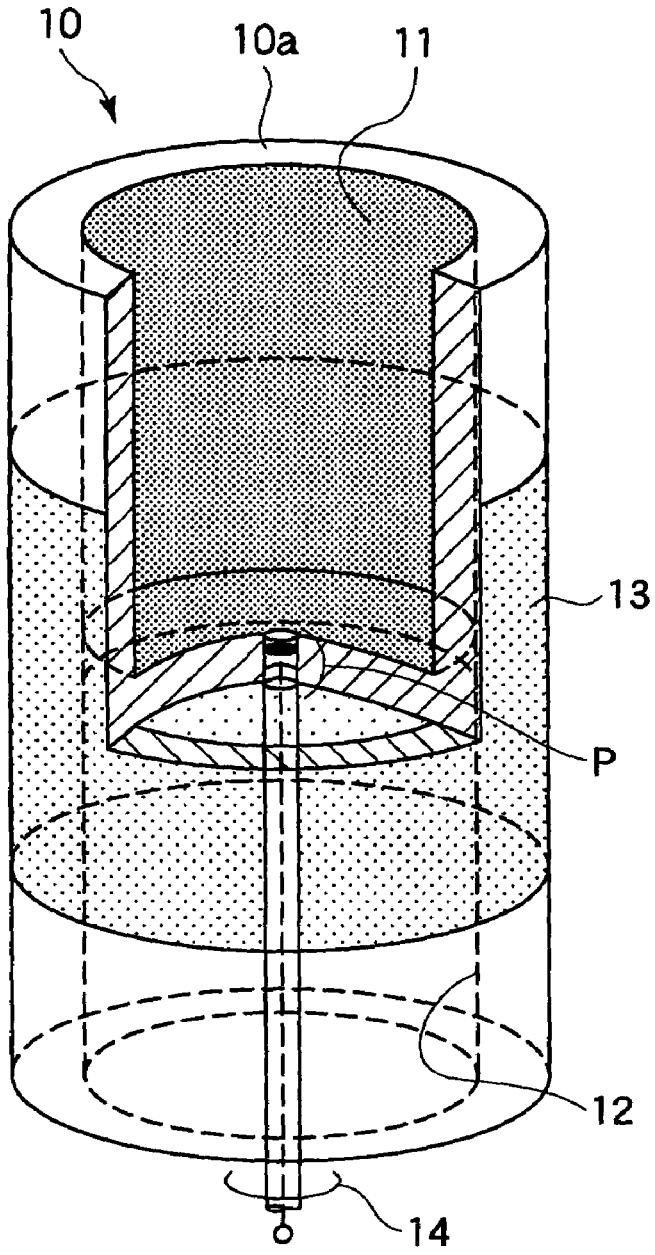
FIG. 12 is a perspective view for schematically showing an antenna device according to a seventh embodiment of the present invention with a part of the antenna device being torn.

FIG. 6 shows the antenna device according to the first embodiment of the present invention with a part of the antenna device being torn. FIG. 7 shows an antenna device according to a second embodiment of the present invention with a part of the antenna device being torn. FIG. 8 shows an antenna device according to a third embodiment of the present invention with a part of the antenna device being torn. FIG. 9 shows an antenna device according to a fourth embodiment of the present invention with a part of the antenna device being torn. FIG. 10 shows an antenna device according to a fifth embodiment of the present invention. FIG. 11 shows an antenna device according to a sixth embodiment of the present invention with a part of the antenna device being torn. FIG. 12 shows an antenna device according to a seventh embodiment of the present invention with a part of the antenna device being torn.

Now, referring to FIG. 6, description will proceed to an antenna device according to a first embodiment of the present invention. As illustrated in FIG. 6, the antenna device 10 according to this embodiment forms a discone antenna and comprises a pole-shaped base member 10*a* which is composed of dielectric material. The pole-shaped base member 10*a* has a cone-shaped inner space formed therein. In an inside surface of the pole-shaped base member 10*a*, a first antenna element 11 is formed by patterning a metal conductor layer. Further, on a plain surface facing the outside of the pole-shaped base member 10*a*, a second antenna element 12 is formed also by circularly patterning a metal conductor layer at the side of a top of the first antenna element 11 with a predetermined space being kept between the top of the first antenna element 11 and the second antenna element 12. The first antenna element 11 and the second antenna element 12 are located with respective rotation central axes thereof being corresponding with each other.

Besides, as a dielectric material of which the pole-shaped base member 10*a* is composed, for example, ceramics (cordierite, forsterite, alumina, glassed ceramics, titanium oxide ceramics, and the like, or mixture of these materials), resin (polytetrafluoroethylene, polyimide, bismareimide, triazine, liquid crystal polymer, and the like), or a composite material of the ceramics and the resin can be used.

In a case that such the antenna device 10 is included in a wireless communication apparatus, the antenna device 10 is mounted on a mounting surface of a substrate (not shown in FIG. 6) with the first antenna element 11 facing the mounting surface. Subsequently, by a coaxial cable 14 that is a feeding line, a signal is supplied to the antenna device 10 from a signal source (not shown in FIG. 6) with a center of the second antenna element 12 being a feeding point P while a ground voltage is supplied to the antenna device 10 from a top of the first antenna element 11 as a feeding point P. As a result, in a case of the discone antenna illustrated in FIG. 6, resonance can be obtained at a wide frequency band that ranges frequencies four times through eight times higher than the lowest frequency rendering an antenna to be resonated.

Electrodes of which the first antenna element 11, the second antenna element 12, and the feeding point P are composed are formed by patterning a metal conductor layer, such as copper, silver, and the like. Concretely, the electrodes are formed by a method that a metal paste, for example, of silver, and the like is burned onto the pole-shaped base member 10*a* by pattern printing, a method that a metal pattern layer is formed by plating, a method that a thin metal film is subjected to patterning by etching, a method that a metal member fabricated by plate work, or the like is fitted on the pole-shaped base member 10*a*, and so on.

In this embodiment, a signal is supplied to the first antenna element 11 by making the second antenna element 12 be at a ground voltage. Alternatively, a signal is supplied to the second antenna element 12 by making the first antenna element 11 be at a ground voltage. This will be applied similarly to the following embodiments.

In addition, except for FIG. 6 thus illustrated and FIG. 12 described later, the coaxial cable 14 is omitted for the brevity of illustration. Further, it is not essential for the antenna device of the present invention to have a feeding line, such as a coaxial cable, and the like.

Thus, in the antenna device 10 according to this embodiment, the first antenna element 11 and the second antenna element 12 are formed integrally in the pole-shaped base member 10*a* composed of dielectric material. Different from a conventional antenna device, it becomes unnecessary that an antenna device having a desirable shape is assembled by the use of additional members each of a separator, or the like together with constitutional members each of an antenna element. As a result, the antenna device 10 can be obtained with a plain structure. In addition, it becomes possible that the antenna device 10 is mounted on a substrate, as it stands.

Further, the first antenna element 11 is formed on inner surface of the pole-shaped base member 10*a*. The first antenna element 11 can be prevented from being injured when the antenna device 10 is handled or mounted on a substrate.

Referring to FIG. 7, description proceeds to an antenna device according to a second embodiment of the present invention. In FIG. 7, illustrated is the antenna device according to the second embodiment. The antenna device according to this embodiment is mounted on a substrate (not shown in FIG. 7) in the direction opposite to that of the first embodiment. Namely, the antenna device 10 according to this embodiment is mounted on the substrate with the second antenna element 12 facing a mounting surface of the substrate. Besides, in this case, a signal is supplied to the first antenna element 11 while a ground voltage is supplied to the second antenna element 12.

Referring to FIGS. 8 and 9, description proceeds to antenna devices according to third and fourth embodiments of the present invention. In these embodiments, the antenna device of the present invention is applied to an antenna other than the discone antenna, respectively.

As illustrated in FIG. 8, the antenna device 10 according to the third embodiment constitutes a biconical antenna. The antenna device 10 comprises a pole-shaped base member 10*a*, a first antenna element 11 and a second antenna element 12. Two conical inner spaces are formed in the pole-shaped base member 10*a* with respective rotation central axes thereof being corresponding with each other and with respective tops thereof facing oppositely to each other. Further, the first antenna element 11 is formed in an inner surface of one of the two conical inner spaces while the second antenna element 12 is formed in an inner surface of another one of the two conical inner spaces. Besides, in the antenna device 10 illustrated in FIG. 8, signals are supplied by the tops of the first antenna element 11 and the second antenna element 12 as a feeding point P.

Next, as illustrated in FIG. 9, the antenna device 10 according to the fourth embodiment constitutes a Brown antenna. The antenna device 10 comprises a pole-shaped base member 10*a*, a first antenna element 11 and a second antenna element 12. As illustrated in FIG. 9, a conical inner space is formed in the pole-shaped base member 10*a*. The first antenna element 11 is formed in the conical inner space. Further, a thrender pole-shaped hole is formed in the pole-shaped base member 10*a* with a rotation axis of the thrender pole-shaped hole is corresponding with that of the first antenna element 11. The second antenna element 12 is formed in an inner surface of the thrender pole-shaped hole by patterning a metal conductor layer. Besides, in the antenna device 10 illustrated in FIG. 9, a signal is supplied by the top of the first antenna element 11 and an end of the second antenna element 12 at the side of the first antenna element 11, namely, the end of the lower side in FIG. 9, as a feeding point P.

Referring to FIGS. 10 and 11, description proceeds to antenna devices according to fifth and sixth embodiments of the present invention.

As illustrated in FIG. 10, the antenna device 10 according to the fifth embodiment forms a discone antenna and comprises a frustum circular cone-shaped base member 10*a* which is composed of dielectric material. The frustum circular cone-shaped base member 10*a* has a cone-shaped inner space formed therein. In an inside surface of the frustum circular cone-shaped base member 10*a*, a first antenna element 11 is formed by patterning a metal conductor layer. Further, on a plain surface facing the outside of the frustum circular cone-shaped base member 10*a*, a second antenna element 12 is formed also by circularly patterning a metal conductor layer at the side of a top of the first antenna element 11 with a predetermined space being kept between the top of the first antenna element 11 and the second antenna element 12. The first antenna element 11 and the second antenna element 12 are located with respective rotation central axes thereof being corresponding with each other.

Besides, the frustum circular cone-shaped base member 10*a* is composed of a dielectric material similar to that of the first through the fourth embodiments.

In a case that such the antenna device 10 is included in a wireless communication apparatus, the antenna device 10 is mounted on a mounting surface of a substrate (not shown in FIG. 10) with the first antenna element 11 facing the mounting surface. Subsequently, by a coaxial cable (not shown) that is a feeding line, a signal is supplied to the antenna device 10 from a signal source (not shown in FIG. 10) with a center of the second antenna element 12 being a feeding point P while a ground voltage is supplied to the antenna device 10 from a top of the first antenna element 11 as a feeding point P. As a result, in a case of the discone antenna illustrated in FIG. 10, resonance can be obtained at a wide frequency band that ranges frequencies four times through eight times higher than the lowest frequency rendering an antenna to be resonated.

Electrodes of which the first antenna element 11, the second antenna element 12, and the feeding point P are composed are formed by patterning a metal conductor layer, similarly to the first through the fourth embodiments.

In this embodiment, a signal is supplied to the first antenna element 11 by making the second antenna element 12 be at a ground voltage.

Thus, in the antenna device 10 according to this embodiment, the first antenna element 11 and the second antenna element 12 are formed integrally in the frustum circular cone-shaped base member 10*a* composed of dielectric material. Different from a conventional antenna device, it becomes unnecessary that an antenna device having a desirable shape is assembled by the use of additional members each of a separator, or the like together with constitutional members each of an antenna element. As a result, the antenna device 10 can be obtained with a plain structure. In addition, it becomes possible that the antenna device 10 is mounted on a substrate, as it stands.

Further, the first antenna element 11 is formed on inner surface of the frustum circular cone-shaped base member 10*a*. The first antenna element 11 can be prevented from being injured when the antenna device 10 is handled or mounted on a substrate.

Referring to FIG. 11, description proceeds to an antenna device according to sixth embodiment of the present invention.

As mentioned before, at least one of the first and the second antenna elements 11 and 12 is formed in the inner surface of the base member 10*a* in the first through the fifth embodiments of the present invention. However, the first antenna element 11 is formed in an outer surface of the base member 10*a* in this embodiment. Namely, as illustrated in FIG. 11, the antenna device 10 according to this embodiment forms a discone antenna and comprises a frustum circular cone-shaped base member 10*a* which is composed of dielectric material. The frustum circular cone-shaped base member 10*a* is mainly consisting of two parts, one is a circular cone-shaped base member 10*a*1 and another is a circular plate-shaped base member 10*a*2. The circular cone-shaped base member 10*a*1 does not have a cone-shaped inner space formed therein, different from those of the first through the fifth embodiments. In other words, the whole of the circular cone-shaped base member 10*a*1 is filled with the dielectric material, as depicted by hatching lines in FIG. 11. Accordingly, the first antenna element 11 is formed on an outer surface of the circular cone-shaped base member 10*a*1. On the other hand, the circular plate-shaped base member 10*a*2 is filled with the dielectric material, similarly to the upper end portions of the pole-shaped base member 10*a* in the first embodiment. Accordingly, the second antenna element 12 is formed on a plain surface of the circular plate-shaped base member 10*a*2, similarly to that of the first embodiment. Besides, in the sixth embodiment, only the first antenna element 11 is formed on the outer surface of the circular cone-shaped base member 10*a*1. However, two antenna elements can be formed on outer surfaces of the base member 10*a*. Namely, for example, the antenna device 10 may form a biconical antenna and comprises two circular cone-shaped base members 10*a*1 each of which is filled with the dielectric material and has an outer surface. The two circular cone-shaped base members 10*a*1 are located with respective tops thereof facing oppositely to each other. With the structure, a first antenna element may be formed on an outer surface of one of the two circular cone-shaped base members 10*a*1 while a second antenna element may be formed on an outer surface of another one of the two circular cone-shaped base members 10*a*1.

Referring to FIG. 12, description proceeds to an antenna device according to a seventh embodiment of the present invention.

As mentioned before, the first and the second antenna elements 11 and 12 are formed in the base member 10*a* in the first through the sixth embodiments of the present invention. However, a third antenna element, that is a parasitic antenna element, may be formed in the base member 10*a* in addition to the first and the second antenna elements 11 and 12. Namely, as illustrated in FIG. 12, the antenna device 10 according to this embodiment forms a dipole antenna and comprises a circular tube-shaped base member 10*a* which is composed of dielectric material and which has a predetermined thickness between inner and outer surfaces thereof. The circular tube-shaped base member 10*a* has two inner spaces formed from both ends of the circular tube-shaped base member 10*a*. A cylindrical first antenna element 11 and a cylindrical second antenna element 12 are formed on the two inner spaces, respectively. Under the condition that the antenna device 10 is mounted in a wireless communication apparatus, by a coaxial cable 14, a signal and a ground voltage are supplied to the antenna device 10, respectively, with end surfaces of the cylindrical first antenna element 11 and the cylindrical second antenna element 12 being used as a feeding point P. Further, the third parasitic antenna element 13 to which neither signals nor ground voltage are feeded is formed on the outer surface of the circular tube-shaped base member 10*a* with a distance corresponding to the predetermined thickness of the circular tube-shaped base member 10*a* being kept with respect to the first and the second antenna elements 11 and 12, as illustrated in FIG. 12. In addition, the third parasitic antenna element 13 is formed partially on the outer surface of the circular tube-shaped base member 10*a* to have a predetermined area on the outer surface, as depicted by the area having plenty of specks in FIG. 12.

Thus, the third parasitic antenna element 13 is formed, as mentioned above, in the antenna device 10 according to this embodiment. With the structure, the antenna device 10 can be tuned to have desirable antenna characteristics by adjusting the third parasitic antenna element 13, for example, by adjusting a size of the predetermined area of the third parasitic antenna element 13 on the outer surface of the circular tube-shaped base member 10*a*.

In FIG. 12, the third parasitic antenna element 13 is formed on the outer surface of the circular tube-shaped base member 10*a*. Alternatively, the third parasitic antenna element 13 can be formed on an inner or a plain surface of the circular tube-shaped base member 10*a*. Further, a configuration of the third parasitic antenna element 13 can be freely determined so that the antenna device 10 may have the above-mentioned desirable antenna characteristics.

As described above, in the antenna device 10 according to the present invention, the first antenna element 11 and the second antenna element 12 are formed integrally in the base member 10*a* composed of dielectric material. Different from a conventional antenna device, it becomes unnecessary that an antenna device having a desirable shape is assembled by the use of additional members each of a separator, or the like together with constitutional members each of an antenna element. As a result, the antenna device 10 can be obtained with a plain structure. In addition, it becomes possible that the antenna device 10 is mounted on a substrate, as it stands.

While this invention has thus far been described in specific conjunction with several embodiments thereof, it will now be readily possible for one skilled in the art to put this invention into effect in various other manners.

For example, as configurations of the base member 10*a*, a pole-shaped base member 10*a* is used in the first through fourth embodiments, respectively while a frustum of circular cone-shaped base member 10*a* is used in the fifth embodiment. However, the base member 10*a* is not restricted to those configurations. The base member 10*a* may have a cylinder-shaped configuration, a pyramid-shaped configuration, a frustum of pyramid-shaped configuration, or the like.

Further, the first antenna element 11 has circular cone-shaped configurations, respectively in the first through fifth embodiments. However, the first antenna element 11 may have various three-dimensional configurations, such as a pyramid-shaped configuration, a pole-shaped (a circular pole-shaped, a triangular prism pole-shaped, a rectangular prism pole-shaped, and the like) configuration, a tube-shaped (a circular tube-shaped, a triangular prism tube-shaped, a rectangular prism tube-shaped, and the like) configuration, a helicoid-shaped configuration, or the like.

Furthermore, as far as the first antenna element 11 is formed to have those three-dimensional configurations, it is not necessary that the first antenna element 11 is formed on a whole of the peripheral surface of the base member 10*a* in the peripheral direction.

Moreover, the second antenna element 12 has circular configurations, respectively in the first through third, and the fifth embodiments while the second antenna element 12 has the circular pole-shaped configuration in the fourth embodiment. However, the second antenna element 12 is not restricted to those configurations. Namely, as far as the second antenna element 12 is formed to have those plane-shaped configurations, the second antenna element 12 may have various two-dimensional configurations, such as square, rectangular, circular, elliptical configurations, and any configurations other than these.

Besides, configurations of the first and the second antenna elements 11 and 12 thus mentioned can be formed by patterning a metal conductor layer on a whole area in line with respective configurations in the first through fifth embodiments. However, the configurations of the first and the second antenna elements 11 and 12 may be formed in another manner. For example, many linear metal conductor layers may be formed radially from a certain point so as to constitute, as a whole, a circular configuration, a circular cone-shaped configuration, or the like. Further, metal conductor layers may be formed with a mesh structure so as to constitute, as a whole, a desirable configuration.

In the interim, when "circular cone" and "pyramid" are used in the specification and claims of this application, the words "circular cone" and "pyramid" include such configurations of "frustum of circular cone" and "frustum of pyramid", respectively, with respective tops being torn.

Besides, the antenna device of the present invention can be used in various wireless communication apparatus, such as, a portable telephone, a mobile terminal, an included antenna of an wireless LAN card, and the like.

What is claimed is:

1. An antenna device for use in a wireless communication apparatus, comprising:

a base member including a dielectric material and which includes a peripheral surface and a plain surface;

a first antenna element which is formed on said peripheral surface of said base member with said first antenna element having a three-dimensional configuration; and a second antenna element which is formed on at least one of said peripheral surface and said plain surface of said base member with a predetermined distance being kept from said first antenna element, said second antenna element having a three-dimensional configuration when formed on said peripheral surface, said second antenna element having a two-dimensional configuration when formed on said plain surface.

2. An antenna device as claimed in claim 1, wherein said three-dimensional configuration of at least one of said first antenna element and said second antenna element comprises a circular cone-shaped configuration.

3. An antenna device as claimed in claim 1, wherein said three-dimensional configuration of at least one of said first antenna element and said second antenna element comprises a pyramid-shaped configuration.

4. An antenna device as claimed in claim 1, wherein said three-dimensional configuration of at least one of said first antenna element and said second antenna element comprises a pole-shaped configuration.

5. An antenna device as claimed in claim 1, wherein said three-dimensional configuration of at least one of said first antenna element and said second antenna element comprises a tube-shaped configuration.

6. An antenna device as claimed in claim 1, wherein said first antenna element is formed on an inner peripheral surface of said base member.

7. An antenna device as claimed in claim 1, wherein said second antenna element is formed on an inner peripheral surface of said base member.

8. An antenna device as claimed in claim 1, wherein said first antenna element and said second antenna element are formed with respective rotation central axes thereof being corresponding with each other.

9. A wireless communication apparatus in which said antenna device as claimed in claim 1 is used, wherein a signal from a signal source is supplied to said first antenna element while a ground voltage is supplied to said second antenna element.

10. A wireless communication apparatus in which said antenna device as claimed in claim 1 is used, wherein a signal from a signal source is supplied to said second antenna element while a ground voltage is supplied to said first antenna element.

11. An antenna device as claimed in claim 1, wherein said base member comprises:

a pole-shaped base member.

12. An antenna device as claimed in claim 11, wherein said pole-shaped base member comprises:

a first conical inner space and a second conical inner space each formed in said pole-shaped base member.

13. An antenna device as claimed in claim 12, wherein a rotation central axes of said first conical inner space corresponds with a rotation central axes of said second conical inner space, and wherein a top face of said first conical inner space and a top face of said second conical inner space are faced oppositely to each other.

14. An antenna device as claimed in claim 12, wherein said peripheral surface of said base member upon which said first antenna is formed comprises:

an inner peripheral surface of said first conical inner space.

15. An antenna device as claimed in claim 12, wherein said peripheral surface of said base member upon which said second antenna is formed comprises;

an inner peripheral surface of said second conical inner space.

16. An antenna device as claimed in claim 1, wherein said pole-shaped base member comprises:

a long and slender cylindrical base member which is longer in the axial direction than in the radial direction.

17. An antenna device for use in a wireless communication apparatus, comprising:

a base member including a dielectric material and which includes a peripheral surface and a plain surface;

a first antenna element which is formed on said peripheral surface of said base member with said first antenna element having a three-dimensional configuration; and a second antenna element which is formed on at least one of said peripheral surface and said plain surface of said base member with a predetermined distance being kept from said first antenna element, said second antenna element having a three-dimensional configuration when formed on said peripheral surface, said second antenna element having a two-dimensional configuration when formed on said plain surface, wherein said two-dimensional configuration comprises a plane-shaped configuration.

18. An antenna device for use in a wireless communication apparatus, comprising:

a base member including a dielectric material and which includes a peripheral surface and a plain surface;

a first antenna element which is formed on said peripheral surface of said base member with said first antenna element having a three-dimensional configuration; and a second antenna element which is formed on at least one of said peripheral surface and said plain surface of said base member with a predetermined distance being kept from said first antenna element, said second antenna element having a three-dimensional configuration when formed on said peripheral surface, said second antenna element having a two-dimensional configuration when formed on said plain surface, further comprising a third antenna element which is formed on said base member with a predetermined distance being kept with respect to said first and said second antenna elements.

19. A wireless communication apparatus in which said antenna device as claimed in claim 18 is used, wherein a signal from a signal source is supplied to said first antenna element while a ground voltage is supplied to said second antenna element, and wherein said third antenna element comprises a parasitic antenna.

20. A wireless communication apparatus in which said antenna device as claimed in claim 18 is used, wherein a signal from a signal source is supplied to said second antenna element while a ground voltage is supplied to said first antenna element, and wherein said third antenna element comprises a parasitic antenna.

* * * * *